US006067908A

United States Patent [19]

Schoeps

[11] Patent Number: 6,067,908

[45] Date of Patent: May 30, 2000

[54] METHOD AND DEVICE FOR KEEPING CLEAN ENDS OF SPRAY DAMPING MECHANISM NOZZLES ON ROTARY PRINTING PRESS

[75] Inventor: Martin Heinz Schoeps, Güntersleben, Germany

[73] Assignee: Koenig & Bauer-Albert Aktiengesellschaft, Wurzburg, Germany

[21] Appl. No.: 09/101,447

[22] PCT Filed: Jan. 17, 1997

[86] PCT No.: PCT/DE97/00076

§ 371 Date: Jul. 16, 1998

§ 102(e) Date: Jul. 16, 1998

[87] PCT Pub. No.: WO97/26996

PCT Pub. Date: Jul. 31, 1997

[30] Foreign Application Priority Data

Jan. 23, 1996 [DE] Germany ..... 196 02 228

[51] Int. Cl.[7] ..... B41F 35/00

[52] U.S. Cl. ..... 101/424; 101/483

[58] Field of Search ..... 101/424, 425, 101/423, 483, 489, 147, 148, 336; 346/140 R

[56] References Cited

U.S. PATENT DOCUMENTS

| | | | |
|---|---|---|---|
| 3,813,675 | 5/1974 | Steffy et al. | 346/75 |
| 4,007,465 | 2/1977 | Chaudhary | 346/140 |
| 4,044,674 | 8/1977 | Smith, Jr. | 101/148 |
| 4,241,656 | 12/1980 | Smith | 101/148 |
| 4,268,836 | 5/1981 | Huliba et al. | 346/75 |
| 4,537,354 | 8/1985 | Eith | 239/102 |
| 4,563,688 | 1/1986 | Braun | 346/1.1 |
| 4,600,928 | 7/1986 | Braun et al. | 346/1.1 |
| 4,849,769 | 7/1989 | Dressler | 346/1.1 |

FOREIGN PATENT DOCUMENTS

| | | |
|---|---|---|
| 0126536 | 11/1984 | European Pat. Off. . |
| 0422400 | 4/1991 | European Pat. Off. . |
| 0621134 | 10/1994 | European Pat. Off. . |
| 3108541 | 11/1982 | Germany . |
| 3209139 | 9/1983 | Germany . |
| 4038662 | 6/1992 | Germany . |

*Primary Examiner*—John S. Hilten
*Assistant Examiner*—Anthony H. Nguyen
*Attorney, Agent, or Firm*—Jones, Tullar & Cooper, P.C.

[57] ABSTRACT

Deposits are removed from the end of a spray dampening nozzle which is used to spray pressurized fluid that is delivered to the nozzle end. This fluid is activated by ultrasound before it exits the nozzle end. The activation of the fluid can be accomplished upstream of, or at the nozzle end. An ultrasound vibrator is used to activate the fluid and is either directly or indirectly connected to the fluid by a vibration transmitter.

2 Claims, 1 Drawing Sheet

METHOD AND DEVICE FOR KEEPING CLEAN ENDS OF SPRAY DAMPING MECHANISM NOZZLES ON ROTARY PRINTING PRESS

FIELD OF THE INVENTION

The present invention relates to a method keeping clean a nozzle mouthpiece of a nozzle of a spray moistening device of a rotary printing press; the and to a device for executing the method.

DESCRIPTION OF THE PRIOR ART

A spray moistening device with spray nozzles, which are arranged next to each other in the axial direction on a so-called spray beam for moistening a printing cylinder of an offset rotary printing press, is known from U.S. Pat. No. 4,044,647.

U.S. Pat. No. 4,241,656 discloses a self-cleaning nozzle of a spray moistening device for a rotary printing press. Here, a moistening agent is swirled with air after exiting from a nozzle mouthpiece.

EP 0 126 536 A2 describes a pushbutton for a ink jet printer. The ink reservoir, the nozzle plate and nozzle bores arranged therein are cleaned by means of ultrasound excitation. The ultrasound excitation is activated during the cleaning operation.

DE 31 08 541 A1 discloses a device for generating a moistening agent fog for a moistening device of an offset printing press, using an ultrasound atomizer.

SUMMARY OF THE INVENTION

It is the object of the present invention to provide a method for keeping the nozzle mouthpieces of a spray moistening device clean, as well as an associated device, by means of which it is possible to perform preventive maintenance on spray nozzles of a spray moistening device without having to remove them.

This object is attained in accordance with the present invention by periodically activating the moistening agent that is supplied to the nozzle mouthpieces of the spray moistening device by the use of ultrasound upstream of, or in the nozzle mouthpieces. An ultrasound vibration transmitter is in communication with the fluid either in an upstream fluid chamber, or at the nozzle mouthpiece;

The advantages which can be achieved by means of the present invention lie, in particular, in that the fluid conducted through the nozzles can be activated by means of ultrasound because of the arrangement of a moistening agent, which in the operational state, is not activated by ultrasound during a spraying process and is charged with pressure, or respectively by an ultrasound vibration transmitter, which can be switched on during a cleaning process. When the fluid activated by ultrasound exits through the nozzles, the paper and ink particles on the nozzle outlet opening, or respectively on the nozzle mouthpiece, are removed.

In this way, it is easily possible to perform preventive cleaning of the spray nozzles without having to remove the nozzles. A long, trouble-free operation of the moistening device is made possible by the present invention.

BRIEF DESCRIPTION OF THE DRAWINGS

The present invention is represented in the drawings by two preferred embodiments and will be described in more detail in what follows. Shown are in.

DESCRIPTION OF THE PREFERRED EMBODIMENTS

Figures 1, 2:
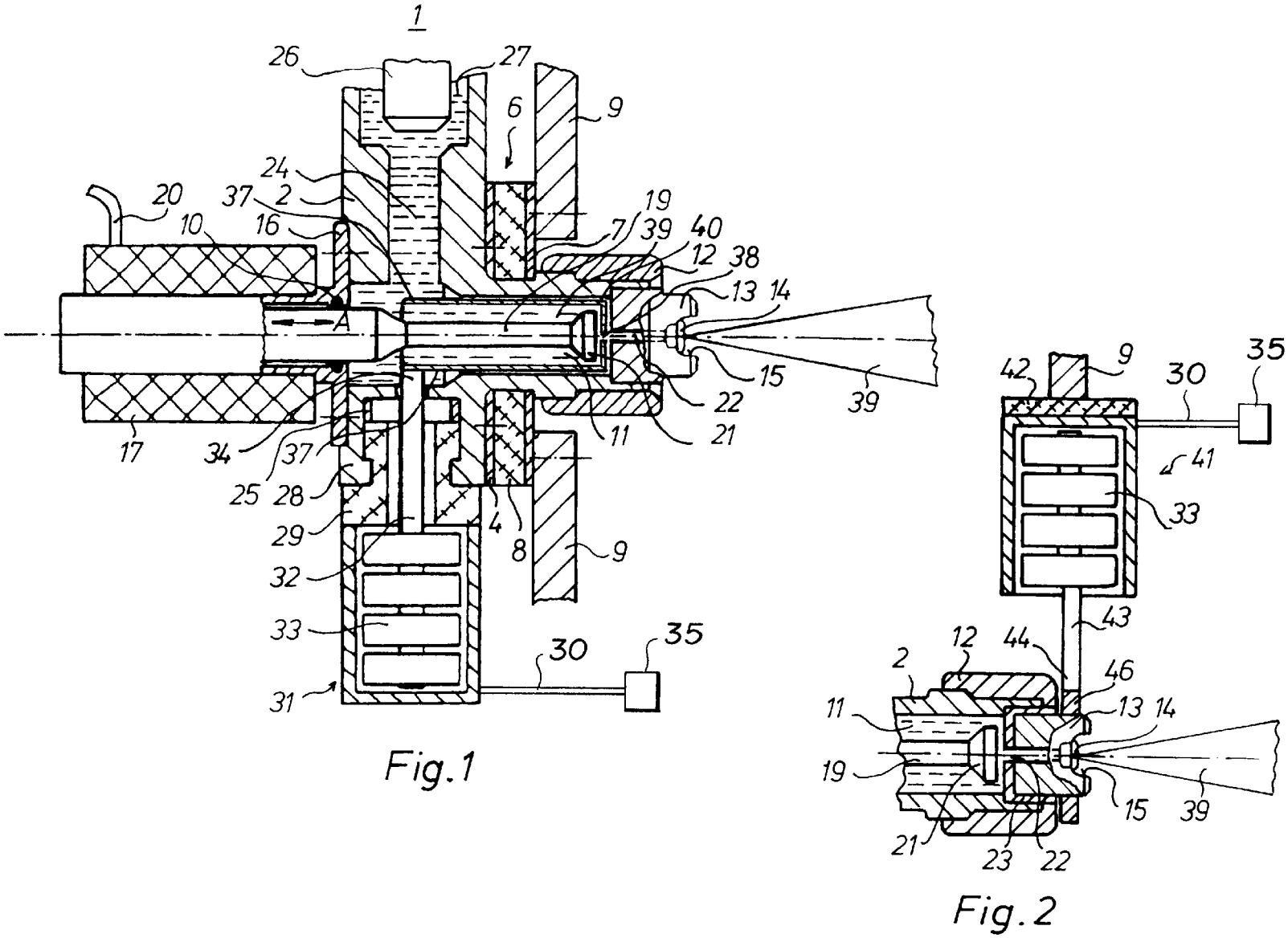
FIG. 1, a cross section through the schematic representation of a spray nozzle unit with a device; in accordance with a first preferred embodiments of the present invention.
FIG. 2, a detailed representation of a spray nozzle with a device in a second preferred embodiment of the present invention.

A nozzle unit 1 of a spray moistening device for moistening objects, such as, in particular a rotatable moistening distribution roller, consists of a nozzle housing 2, which is fastened by means of fastening elements, for example screws, on a first sheet metal plate 4 of a vibration-damping plate generally at 6. The vibration-damping plate 6 is arranged by means of screws on a crosspiece 9 of a nozzle beam. crosspiece 9 receives a plurality of nozzle units 1 arranged at a distance next to each other.

The nozzle housing 2 has a chamber 11, which extends in the interior of nozzle housing 2 in the horizontal direction, for example, and which is bordered on one side by a nozzle mouthpiece 13, held in place by a union nut 12, and a nozzle 14 fastened thereon. On its side opposite the nozzle mouthpiece 13, the chamber 11 is bordered by a coil holder 16, that is screwed to the nozzle housing 2, and which supports or holds a magnetic coil 17. A valve rocker 19 is arranged in the interior of the magnetic coil 17 valve rocker 19 has, at its end facing the nozzle mouthpiece 13, a sealing element 21 for closing an outlet bore 22 located in the nozzle mouthpiece 13. The magnetic coil 17 is provided with a connecting cable 20. During the operation of the magnetic coil 17, the valve rocker 19 can be moved back and forth in the horizontal direction A, so that the bore 22 located in the nozzle mouthpiece 13 will be opened and closed by means of the sealing element 21. The valve rocker 19 is sealed against the chamber 11 at the end of the magnetic coil 17 by means of a sealing ring 10.

The nozzle housing 2 has a supply bore 24, for example on its upper side, which is connected with the chamber 11 and, via a valve 26, with a pressurized water inlet 27. Opposite the bore 24 for the water inlet 27, the nozzle housing 2 is provided with a fastening connector 28, which is also connected with the chamber 11. The fastening connector 28 receives, in its axial direction, a profiled, pipe-shaped intermediate piece 29, which is made of a vibration-damping material and on whose end is fastened a known ultrasound vibration generator 31. The ultrasound vibration generator 31 is provided with a cable 30 extending to a controls means 35. A sealing ring 25 is arranged between the intermediate piece 29 and the nozzle housing 2.

The ultrasound vibration generator 31 can be embodied as a piezo-mechanical ultrasound vibration generator with a generated frequency between 20 and 30 kHz, which has a plurality, for example four, ceramic rings 33 arranged one behind the other on a rod-shaped vibration transmitter 32. An interior end 34 of the rod-shaped vibration transmitter 32, which points in the direction toward the chamber 11 and protrudes out of the ultrasound vibration generator 31, extends at least as far as into the chamber 11, as seen in FIG. 1.

The following procedure is followed in the course of cleaning the nozzle insert 14, or respectively the nozzle mouthpiece 13: the sealing element 21, which is located on the valve rocker 19, is fixed in place at a distance from the outlet bore 22 of the nozzle mouthpiece 13 in such a way that when the valve 26 is open a pressurized fluid 39, for example water, can exit through the chamber 11, the outlet bore 22 as well as the bore in the nozzle insert 14 at a spraying pressure of 3.5 bar, for example. The water inside the chamber 11 is activated by ultrasound by switching on the ultrasound vibration generator 31 through the control means 35. In the process, the water is alternatingly placed in a traction phase and an overpressure phase by means of the vibration transmitter 32 protruding into the chamber 11 with its vibration-transmitting end 34. When the water exits the nozzle insert 14, the shock waves being generated in the water destroy the accumulations of dirt, typically consisting of paper and ink particles, located on the nozzle mouthpiece 13 or on the nozzle insert 14.

The vibration-damping components 29, 6 are arranged to protect the nozzle housing 2 as well as the crosspiece 9 supporting the nozzle unit 1 from direct ultrasonic effects.

In accordance with a variant of the above described embodiment, the vibration as seen in FIG. 1, transmitting end 34 of the vibration transmitter 32 is connected with the beginning or first or inner end of a vibration-transmitting cup 37 that is arranged coaxially with the valve rocker 19. An outer or second end 40 of the vibration-transmitting cup 37 extends as far as the nozzle mouthpiece 13 and is provided there with a centered bore 38. Because of this arrangement, during the cleaning process, the fluid 39 supplied through the valve 26 and located in the chamber 11 can pass through the outlet bore 22 as well as the nozzle insert 14 when the sealing element 21 of the valve rocker 19 has been retracted.

Because of the additional inclusion of the vibration-transmitting cup 37, it is possible to transmit the ultrasound directly as far as the vicinity of the nozzle mouthpiece 13 and therefore into the vicinity of the nozzle insert 14. Inside the chamber 11, the fluid 39 is thus in direct connection with the vibration transmitter which includes the transmitter 31, rod 32 and cup 37.

In accordance with a second preferred embodiment of the present invention, an ultrasound vibration generator 41 is arranged, fixed in place on the crosspiece 9, by means of a vibration-damping holder 42, and above a nozzle mouthpiece 13 receiving a nozzle insert 14, all as seen in FIG. 2. A rod-shaped vibration transmitter 43 connects a number of ceramic rings 33. This vibration transmitter 43 is fixedly connected, with its vibration-transmitting end 44, which is located outside of the ultrasound vibration generator 41, with a ring-shaped holder 46 that is fixedly arranged around the nozzle mouthpiece 13, or which is connected directly with the nozzle mouthpiece 13. In this case, the nozzle mouthpiece 13 can be provided with a coating 23, which is insensitive to ultrasound vibrations, on its circumference as well as on its side facing away from the nozzle insert 14, again as shown in FIG. 2.

The fluid 39 exiting from the nozzle insert 14 is in indirect contact, -via the nozzle insert 14, the nozzle mouthpiece 13, and the vibration transmitter 43 with the ultrasound vibration generator 41.

It is also possible to clean a nozzle insert 14 during the clocked or timed output of the moistening agent through the nozzle insert 14, i.e. during the opening of the electromagnetically actuated valve rocker 19, or respectively of the sealing element 21. The flowthrough amount of moistening agent through the nozzle insert 14 is a function of the press speed. With a continuous valve opening time, for example of 15 ms, a clock period length, for example of 250 ms, can be changed. By means of the permanent switching on of the ultrasound vibration generator 31 or 41 over a defined period of time, for example 30 s, the moistening agent exiting the nozzle insert 14 is activated several times by ultrasound and thus will have destroyed the paper and ink particles located at the nozzle insert 14.

The same result can be achieved if the moistening agent is in indirect contact with the ultrasound transmitter 32 or 43.

While preferred embodiments of a method and device for keeping clean ends of spray damping mechanism nozzles on a rotary printing press in accordance with the present invention have been set forth fully and completely hereinabout, it will be apparent to one of skill in the art that a number of changes in, for example, the types of printing press used, the specific type of printing being done, the fluid supply system and the like may be made without departing from the true spirit and scope of the present invention which is accordingly to be limited only by the following claims.

What is claimed is:

1. A method for keeping a nozzle mouthpiece of a nozzle of a spraying device for a spray moistening device of a rotary printing press clean including:

providing a moistening fluid;

providing a spray moistening device;

providing a nozzle unit in said spray moistening device, said nozzle unit having a moistening fluid receiving chamber and a nozzle mouthpiece;

selectively operating said spray moistening device in one of an operational state and a cleaning process;

supplying said moistening fluid under pressure to said nozzle mouthpiece through said moistening fluid receiving chamber while said spray moistening device is operating in both said operational state and said cleaning process;

providing an ultrasound vibration generator;

providing an ultrasound vibration transmitter extending between said ultrasound vibration generator and said nozzle unit;

operating said ultrasound vibration generator;

using said ultrasound vibration transmitter for ultrasonically activating said moistening fluid supplied to said nozzle mouthpiece only when said spray moistening device is operating in said cleaning process; and using said ultrasonically activated moistening fluid for cleaning said nozzle mouthpiece only when said spray moistening device is operating in said cleaning process.

2. A device for keeping a nozzle mouthpiece of a nozzle of a spraying device for a spray moistening device of a rotary printing press clean comprising:

a spray moistening device operable in both an operational state and a cleaning process, said spray moistening device including a nozzle unit;

a nozzle housing in said nozzle unit, said nozzle housing including a moistening fluid receiving chamber;

means to supply a moistening fluid to said moistening fluid receiving chamber;

a nozzle mouthpiece secured in said nozzle housing in fluid communication with said fluid receiving chamber and receiving said moistening fluid;

a periodically operable ultrasound vibration generator; and an ultrasound vibration transmitter extending between said ultrasound vibration generator and said nozzle unit and ultrasonically activating said moistening fluid in said nozzle mouthpiece, said ultrasound vibration generator including control means for operating said ultrasound vibration generator to ultrasonically activate said moistening fluid through said ultrasound vibration transmitter only when said spray moistening device is operating in said cleaning process.

* * * * *